US006394903B1

(12) United States Patent
Lam

(10) Patent No.: US 6,394,903 B1
(45) Date of Patent: May 28, 2002

(54) TOY DICE

(75) Inventor: Kim Wing Lam, Hong Kong (HK)

(73) Assignee: Star H.K. Electronic Ltd. (HK)

( * ) Notice: Subject to any disclaimer, the term of this patent is extended or adjusted under 35 U.S.C. 154(b) by 0 days.

(21) Appl. No.: 09/768,085

(22) Filed: Jan. 23, 2001

(51) Int. Cl.[7] ..... A63F 9/24

(52) U.S. Cl. ..... 463/22; 463/1; 273/460; 273/146; 446/268; 446/269; 446/270; 446/297; 446/491

(58) Field of Search ..... 463/1, 16, 22, 463/47; 273/236–237, 138.1, 138.2, 146, 459–461; 446/168, 175, 268–270, 297, 431, 438, 484–486, 491

(56) References Cited

U.S. PATENT DOCUMENTS 4,034,988 A * 7/1977 Goldner et al. ..... 273/138 A
D269,984 S * 8/1983 McKechnie ..... D21/41
4,641,840 A * 2/1987 Larson ..... 273/138 A
4,817,952 A * 4/1989 Biro et al. ..... 273/153 S
4,858,931 A * 8/1989 McKechnie ..... 273/138 A
5,058,894 A * 10/1991 Levinn et al. ..... 273/153 R
5,949,010 A * 9/1999 Hacker ..... 84/476
6,220,594 B1 * 4/2001 Peng ..... 273/146
6,331,145 B1 * 12/2001 Sity et al. ..... 463/22

* cited by examiner

*Primary Examiner*—Jessica J. Harrison
*Assistant Examiner*—Scott E. Jones
(74) *Attorney, Agent, or Firm*—Jackson Walker L.L.P.

(57) ABSTRACT

A toy dice comprising a cubical body having six sides, and an internal electronic operating circuit including an integrated circuit configured to perform six electronic playing functions associated with the sides of the dice body respectively. A position sensor is located within the dice body and connected to the integrated circuit for sensing which side of the dice body faces up when the dice is rolled and, in response, triggering the integrated circuit to perform the corresponding playing function associated with that side.

12 Claims, 4 Drawing Sheets

TOY DICE

SUMMARY OF THE INVENTION

According to the invention, there is provided a toy dice comprising a substantially cubical body having six sides, an internal electronic operating circuit including an integrated circuit configured to perform at least two electronic playing functions associated with corresponding first and second sides of the dice body, and a position sensor located within the dice body and connected to the integrated circuit for sensing whether or not one of the first and second sides of the dice body faces up when the dice is rolled and, if so, triggering the integrated circuit to perform the corresponding playing function associated with that side.

Preferably, the integrated circuit is configured to perform a corresponding electronic playing function associated with each of the six sides of the dice body, and the position sensor is arranged to sense the side of the dice body that faces up when the dice is rolled and, in response, to trigger the integrated circuit to perform the corresponding playing function associated with that side.

In a preferred embodiment, the operating circuit includes depression means connected to the integrated circuit and provided on at least one of the first and second sides of the dice body, and the associated playing function is an interactive game requiring a player to press the depression means.

More preferably, the operating circuit further includes a sound generator controlled by the integrated circuit to provide an audible signal in relation to the depression means while the interactive game is being played.

It is preferred that the operating circuit further includes a light generator controlled by the integrated circuit to provide a light signal in relation to the depression means while the interactive game is being played.

It is preferred that the operating circuit includes a sound generator controlled by the integrated circuit to provide an audible signal comprising playing a tune and giving a verbal instruction, while an aforesaid playing function is being performed.

It is preferred that the position sensor comprises a cavity having at least two regions opposite the first and second sides of the dice body respectively, an object held captive within the cavity for movement under the action of gravity to any one of the regions, and detecting means provided at each of the first and second regions for detecting the object moving to that region as a result of the dice stopping with the opposite first or second side facing up.

In a specific construction, the position sensor comprises a cavity having six regions opposite the respective sides of the dice body, an object held captive within the cavity for movement under the action of gravity to any one of the regions, and detecting means provided at each said region for detecting the object moving to that region as a result of the dice stopping with the opposite side facing up.

More specifically, the position sensor includes a shell to define the cavity, said shell being formed with six equiangularly spaced pockets for receiving the object.

It is preferred that the object is electrically conductive, and the detecting means, at each region comprises a pair of electrical contacts spaced apart for electrical connection by the object.

It is preferred that the detecting means at each region comprises a micro switch.

It is preferred that the detecting means at each region comprises a photo sensor.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
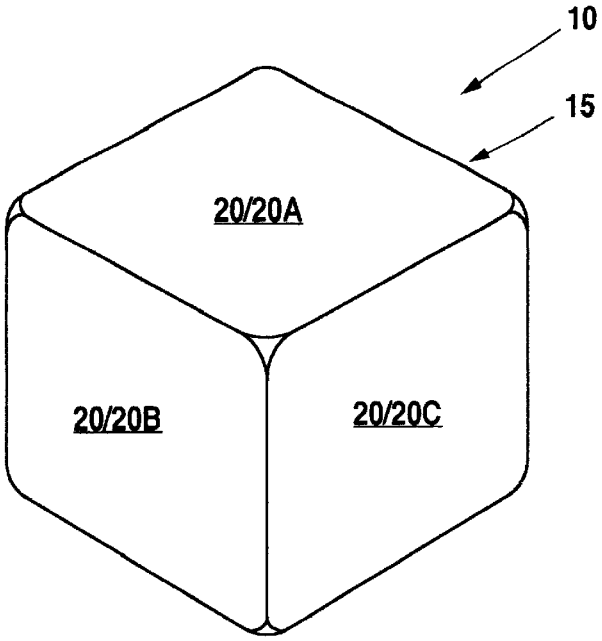
FIG. 1 is a simplified perspective view of an embodiment of a toy dice in accordance with the invention.

Referring firstly to FIGS. 1 to 5 of the drawings, there is shown a toy dice 10 embodying the invention, which dice has a generally cubical body 15 having round corners and edges and six square sides 20 generally or 20A to 20F (FIG. 1). The dice 10 incorporates a position sensor 30 located centrally within the dice body 15 for sensing which side 20 of the dice 10 faces up when the dice 10 is thrown or rolled. The dice 10 further incorporates an internal electronic operating circuit including an integrated circuit 50 which is programmed to perform six electronic playing functions or games associated with the corresponding body sides 20. Upon identification of the top side 20 of the dice 10, the position sensor 30 triggers the operating circuit, to start the function or game associated with that particular top side 20.

Figure 2:
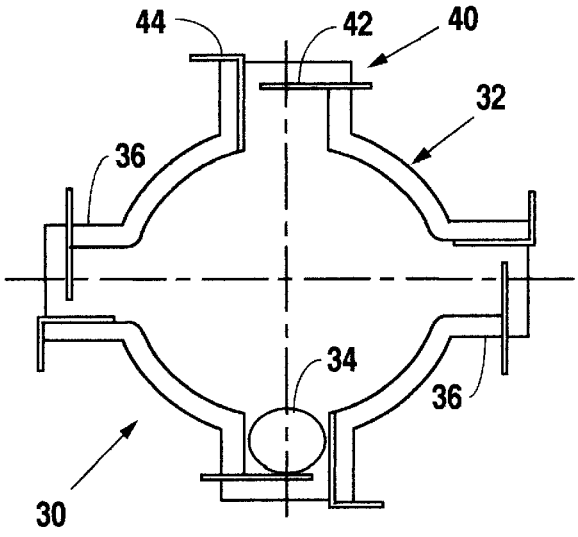
FIG. 2 is a cross-sectional side view of a position sensor of the dice of FIG. 1.
Figure 3:
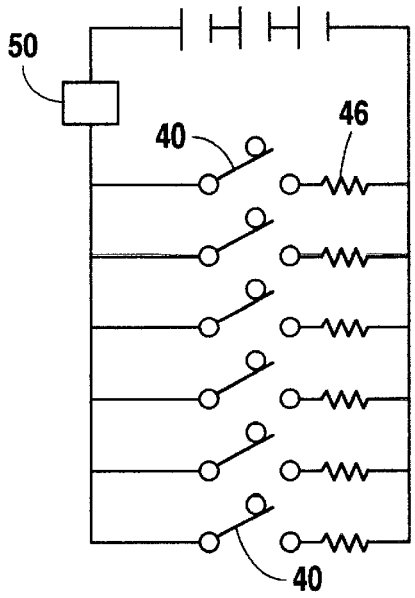
FIG. 3 is a circuit diagram showing an electronic operating circuit of the dice of FIG. 1, including the position sensor of FIG. 2.

The position sensor 30 has a generally spherical shell 32 to define a cavity and an electrically conductive metal ball 34 held captive within the shell 32 for free movement. The shell 32 is formed with six equiangularly spaced, in three dimensions, side recesses in the form of pockets 36 which face inwards and are just sufficiently large to receive the metal ball 34 (FIG. 2).

The pockets 36 can be divided into three pairs, each of two opposite pockets 36 sharing a common axis, lying along respective mutually perpendicular axes which coincide with, or are at least parallel to, the x-, y- and z-axes of the dice body 15. The axis of each pocket 36 extends perpendicular to the adjacent or opposite side 20 of the dice body 15 and are preferably aligned with the common central axis of the two dice body sides 20.

Each pocket 36 includes, at its bottom, a trigger 40 formed by a pair of electrically conductive fixed contact plates 42 and 44. The contact plates 42 and 44 extend on the bottom and one side of the pocket 36 respectively and are spaced apart by a small gap from each other for electrical connection by the metal ball 34 when the latter enters into that pocket 36 under the action of gravity. The trigger 40 operates like an electrical switch, with the contact plates 42 and 44 acting as a pair of fixed contacts and the metal ball 34 acting as a moving contact therefor.

The six triggers 40 are connected, at the outer ends of the contact plates 42 and 44 of each pair, together in parallel by wires and then to the integrated circuit 50. The individual circuit of each trigger 40 may include a resistor 46 which has a resistance different from those of the resistors 46 of the other five triggers 40, such that the triggers 40 are distinguishable from one another by the integrated circuit 50. Alternatively, the triggers 40 may be connected to separate pins of the integrated circuit 50 for individual input.

Figure 4:
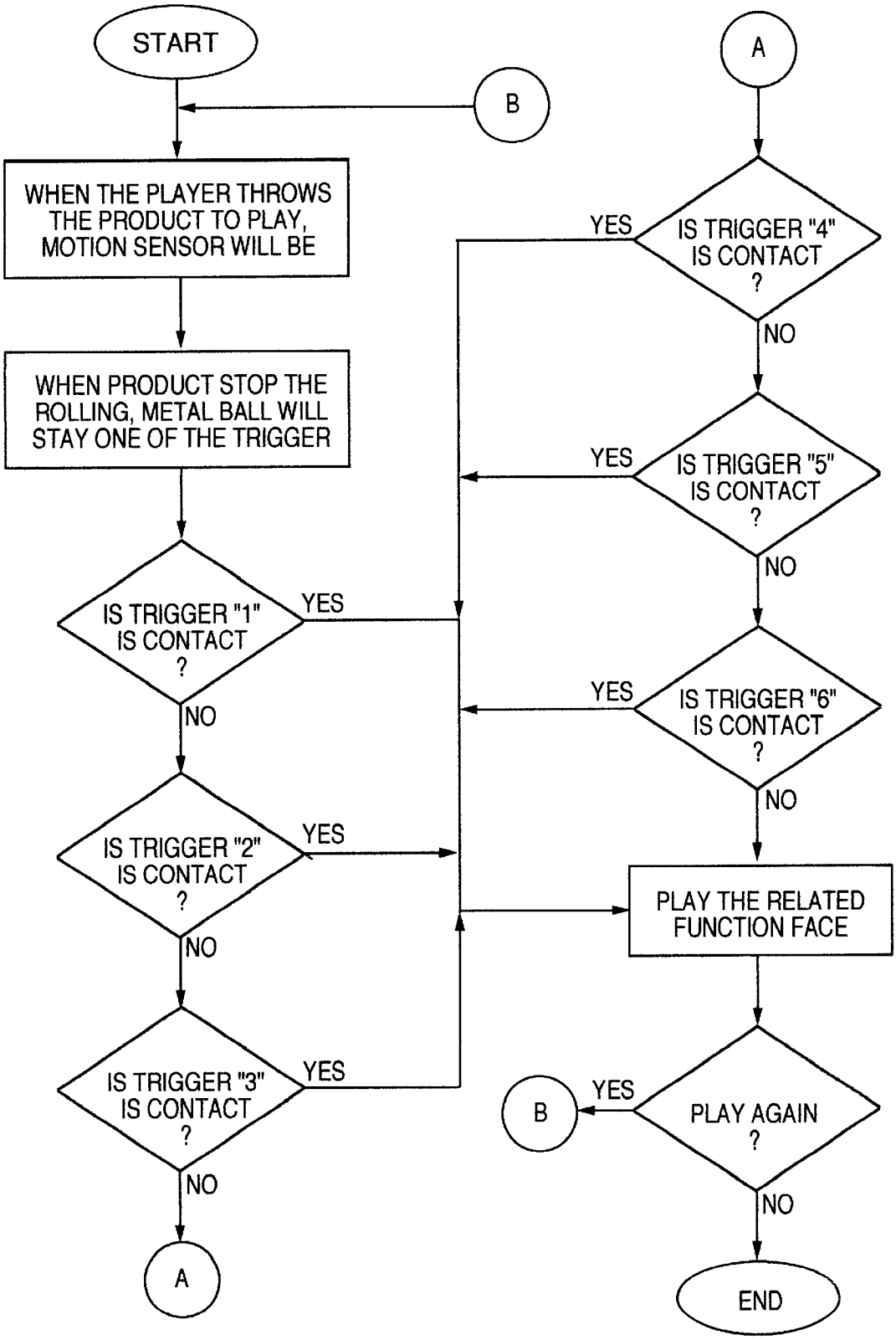
FIG. 4 is a flow chart illustrating the operation of the operating circuit of FIG. 3.

In operation, the player is required to roll the dice 10. When the dice 10 stops rolling, the metal ball 34 will fall into and stay within the lowermost pocket 36 of the shell 32, whereby the lowermost trigger 40 is closed to switch on or activate the function or game associated with the opposite top side 20 of the dice 10. The integrated circuit 50 is programmed to check the status of the triggers 40 sequentially for identifying the one that is closed (contact) and then to play the corresponding function or game (FIG. 4).

Figure 5:
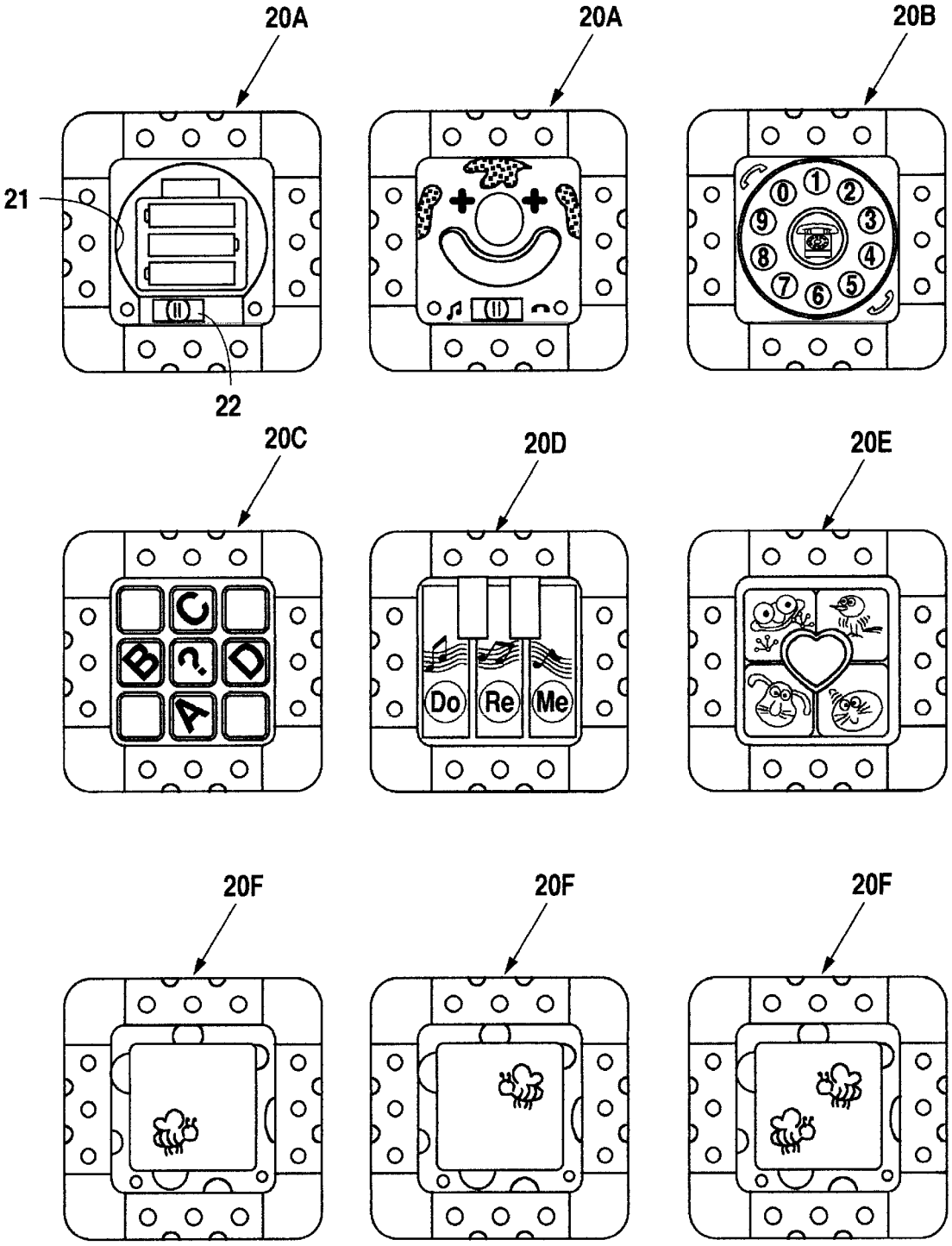
FIG. 5 consists of nine views showing the designs of all six sides of the dice of FIG. 1, with each design being made for a respective electronic playing function arranged to be triggered by the position sensor of FIG. 2.

Although this is not clearly shown in the drawings, in order to play the functions or games, the operating circuit includes an internal piezoelectric buzzer for sound/music generation and, as provided on the dice body sides 20 where appropriate, depression buttons or keys for player's action and light emitting diodes for visual indication. The first side 20A of the dice body 15 is openable as a lid to reveal a battery compartment 21 and includes a slide switch 22 for switching on/off of the operating circuit and/or selecting its modes of operation (FIG. 5).

An Interactive Mode may be selected by means of the switch 22. In this mode, the toy dice 10 will play a short melody and then play "give me a roll" while it is rolling. When the dice 10 stops, a sound effect (spring sound) will be given and then the game associated with the top dice side 20 will be played.

If the first side 20A, which shows a joker, is the top side, a melody (joker singing) will be played, followed by "Give me a ROLL again".

If the second side 20B, which shows a telephone dial, is the top side, "Please dial three number to find William" will be played. If the player can dial three times, i.e. pressing the dial, in three seconds, "Excellent" will be played, otherwise "Nice try, try again" will be played If the third side 20C, which shows letters A to D, is the top side, "Please press the letter A" will be played. A correct pressing will result in "Excellent", otherwise "Nice try, try again". The same repeats for the other letters.

If the fourth side 20D, which shows a piano, is the top side, "Please follow the flash lights to press buttons" will be played. Correct pressings will result in "Excellent" with a sound effect, otherwise "Nice try, try again" with a different sound effect.

If the fifth side 20E, which shows four animals, is the top side, "Please press the Dog" will be played. A correct pressing will result in "Excellent", otherwise "Nice try, try again". The same repeats for the other animals.

If the sixth side 20F, which depicts a magic mirror, is the top side, a melody will be played and the mirror will show smile faces of red and green flashing, followed by "Give me a roll again".

A Play Mode may be selected by means of the switch 22, in which the pressing of the button(s) on the top side 20 of the dice 10 will result in the playing of a sound, music tune/note or song relevant to the theme of the button(s).

Figure 6:
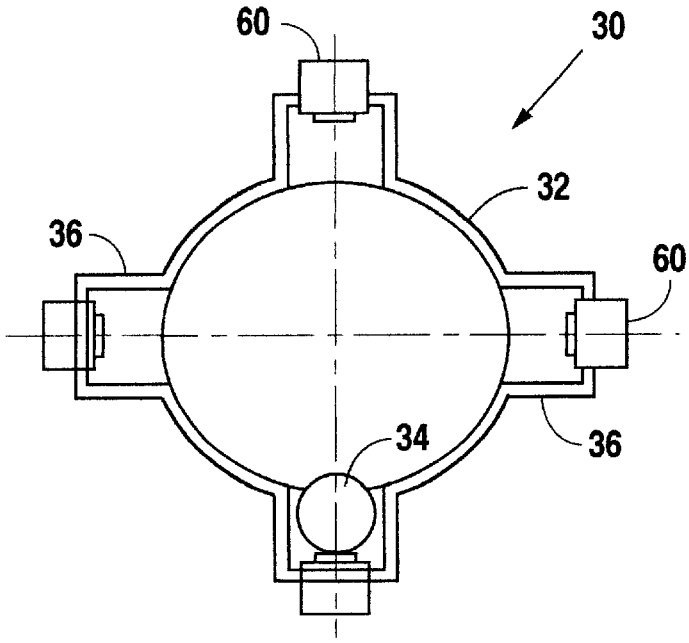
FIG. 6 is a cross-sectional side view of another position sensor suitable for use in the dice of FIG. 1.
Figure 7:
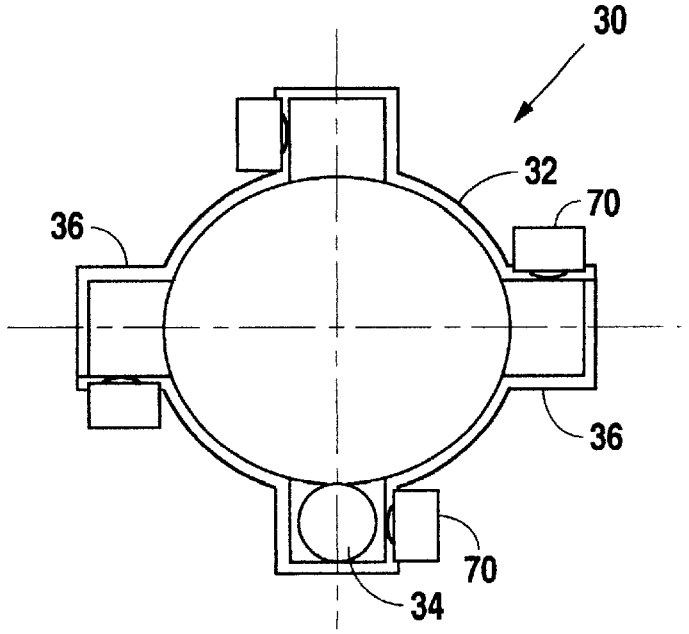
FIG. 7 is a cross-sectional side view of yet another position sensor suitable for use in the dice of FIG. 1.

As shown in FIG. 6, the aforesaid triggers of the position sensor 30 may be implemented by respective micro switches 60 in place of the simple contact plates 42 and 44. As a further alternative, photo sensors 70 may be used which provide a signal when the ball 34 blocks light off.

The invention has been given by way of example only, and various other modifications of and/or alterations to the described embodiment may be made by persons skilled in the art without departing from the scope of the invention as specified in the appended claims.

What is claimed is:

1. A toy dice comprising a substantially cubical body having six sides, an internal electronic operating circuit including an integrated circuit configured to perform at least two electronic playing functions associated with a first and a second side of the six sides of the dice body, and a position sensor located within the dice body and connected to the integrated circuit for sensing whether either the first or the second side of the six sides of the dice body faces up when the dice is rolled and, if so, triggering the integrated circuit to perform the corresponding playing function associated with the side facing up.

2. The toy dice as claimed in claim 1, wherein the integrated circuit is configured to perform a corresponding electronic playing function associated with each of the six sides of the dice body, and the position sensor is arranged to sense the side of the dice body that faces up when the dice is rolled and, in response, to trigger the integrated circuit to perform the corresponding playing function associated with the side facing up.

3. The toy dice as claimed in claim 1, wherein the operating circuit includes depression means connected to the integrated circuit and provided on at least one of the first and second sides of the six sides of the dice body, and the associated playing function is an interactive game requiring a player to press the depression means.

4. The toy dice as claimed in claim 3, wherein the operating circuit further includes a sound generator controlled by the integrated circuit to provide an audible signal in relation to the depression means while the interactive game is being played.

5. The toy dice as claimed in claim 3, wherein the operating circuit further includes a light generator controlled by the integrated circuit to provide a light signal in relation to the depression means while the interactive game is being played.

6. The toy dice as claimed in claim 1, wherein the operating circuit includes a sound generator controlled by the integrated circuit to provide an audible signal comprising playing a tune and giving a verbal instruction, while an aforesaid playing function is being performed.

7. The toy dice as claimed in claim 1, wherein the position sensor comprises a cavity having at least two regions opposite the first and second side of the six sides of the dice body respectively, an object held captive within the cavity for movement under the force of gravity to any one of the regions, the detecting means provided at each of the first and the second regions for detecting the object moving to that region as a result of the dice stopping with the opposite of either the first or the second side of the six sides facing up.

8. The toy dice as claimed in claim 2, wherein the position sensor comprises a cavity having six regions opposite respective sides of the dice body, an object held captive within the cavity for movement under the force of gravity to any one of the regions, and detecting means provided at each said region for detecting the object moving to that region as a result of the dice stopping with an opposite side facing up.

9. The toy dice as claimed in claim 8, wherein the position sensor includes a shell to define the cavity, said shell being formed with six equiangularly spaced pockets for receiving the object.

10. The toy dice as claimed in claim 7, wherein the object is electrically conductive, and the detecting means at each region comprises a pair of electrical contacts spaced apart for electrical connection by the object.

11. The toy dice as claimed in claim 7, wherein the detecting means at each region comprises a micro switch.

12. The toy dice as claimed in claim 7, wherein the detecting means at each region comprises a photo sensor.

* * * * *